US005934087A

United States Patent [19]

Watanabe et al.

[11] Patent Number: 5,934,087

[45] Date of Patent: Aug. 10, 1999

[54] REFRIGERATING APPARATUS

[75] Inventors: Yasushi Watanabe, Shiga; Toru Yasuda; Hisao Wakabayasl, both of Otsu, all of Japan

[73] Assignee: Matsushita Electric Industrial Co., Ltd., Osaka, Japan

[21] Appl. No.: 08/921,835

[22] Filed: Sep. 2, 1997

[30] Foreign Application Priority Data

Oct. 18, 1996 [JP] Japan ..... 8-275787

[51] Int. Cl.[6] ..... F25B 49/02

[52] U.S. Cl. ..... 62/126; 62/129

[58] Field of Search ..... 62/125, 126, 127, 62/129, 130, 209, 208

[56] References Cited

U.S. PATENT DOCUMENTS

| | | | |
|---|---|---|---|
| 5,009,076 | 4/1991 | Winslow | 62/129 |
| 5,150,584 | 9/1992 | Tomasov et al. | 62/126 X |
| 5,241,833 | 9/1993 | Ohkoshi | 62/129 X |

FOREIGN PATENT DOCUMENTS

| | | |
|---|---|---|
| 62-15896 | 1/1987 | Japan . |
| 1-107070 | 4/1989 | Japan . |
| 6-137725 | 5/1994 | Japan . |

*Primary Examiner*—Harry B. Tanner
*Attorney, Agent, or Firm*—Ratner & Prestia

[57] ABSTRACT

An apparatus for detecting refrigerant leak in a refrigerating apparatus using refrigerant and a heat pump type refrigerating apparatus at low cost is presented. A refrigerant leak is judged from the differential temperature and the running time, by comprising a refrigeration system including a compressor, an evaporator, an expansion device, and a condenser, being sequentially coupled annularly by a conduit, a first temperature detector for detecting the air temperature of suction port of the evaporator, a second temperature detector for detecting the refrigerant temperature at the middle part of the evaporator, a differential temperature detector for calculating the differential temperature of the detectors, and a running time detector for storing the cumulative running time of the compressor.

35 Claims, 8 Drawing Sheets

REFRIGERATING APPARATUS

FIELD OF THE INVENTION

The present invention relates to a refrigerating apparatus using a refrigerant and a heat pump type refrigerating apparatus, and more particularly to a refrigeration system control apparatus for detecting a refrigerant leak.

BACKGROUND OF THE INVENTION

Recently, from the standpoint of global environmental conservation, regulations on substances destroying the ozone layer are being fortified, and among them, as for chlorofluorocarbons (CFCs) known to have a particularly strong destructive force, total disuse was decided at the end of 1995. At the same time, as for hydrochlorofluorocarbons (HCFCs) relatively small in destructive force, regulation of total emission started in 1996, and total disuse in future was decided. In this background, refrigerants to replace CFCs and HCFCs are being developed. It is, accordingly, proposed to use hydrofluorocarbons (HFCs) which do not destroy the ozone layer, but as far as known so far, there is no HFC that can be used alone to replace the HCFCs being presently used in the refrigerating machine and air-conditioner. Therefore, a non-azeotropic mixed refrigerant mixing two or more HFC refrigerants is most highly expected. In particular, a mixed refrigerant of HFC-32 and HFC-125 is a most promising candidate as a substitute refrigerant for HCFC-22 (hereinafter called R22). One of its representative examples is R410A (HFC-32/125=50/50 wt. %).

FIG. 8 is a characteristic diagram showing effects of ratio of charging refrigerant of R22 or R410A on the temperature of compressor coil in a conventional refrigerating apparatus. The ratio of charging refrigerant refers to the ratio of the actual refrigerant amount to the specified refrigerant amount of the refrigerating machine. As known from FIG. 8, when the refrigerating machine or air-conditioner using conventional R22 runs short of refrigerant, along with elevation of compression ratio, the discharge temperature hikes, and the circulation of the refrigerant drops. As a result, the cooling effect declines, and the temperature of the compressor coil elevates. The shaded area in the diagram refers to an example of compressor stopping point by a compressor overload protective device of a small-sized room air-conditioner mounting a constant speed compressor. Considering this example, it is known that the compressor stops when the ratio of charging refrigerant is about 70% in the refrigerating apparatus using R22, that is, when a refrigerant leak of about 30% occurs. (it must be noted, however, this ratio varies somewhat depending on the type of the overload protective device and air-conditioning load.) Therefore, in a refrigerating apparatus using R22, when a refrigerant leak occurs, the compressor overload protective device is actuated by elevation of discharge temperature. It was therefore possible to detect a refrigerant leak early indirectly.

In FIG. 8, however, when running short of refrigerant R410A, rise of discharge temperature of compressor coil is smaller than that in the case of R22, and the cooling effect is enhanced by increase of circulation of refrigerant R410A. Accordingly, it is lower than the discharge temperature R22 of the compressor coil when using R410A. This discharge temperature characteristic of the compressor coil in the event of shortage of refrigerant R410A is a feature of a mixed refrigerant of HFC-32/125. As seen therefrom, when an overload protective device of compressor for R22 machine is used in the refrigerating apparatus using R410A, the compressor can operate in a range of up to the ratio of charging refrigerant R410 of about 30%. Hence, as far as the user does not notice shortage of capacity due to insufficient refrigerant, continuous operation may be executed for a long time.

Methods for detecting shortage of refrigerant amount are disclosed in Japanese Laid-out Patents 62-158966, 1-107070, and 6-137725.

In Japanese Laid-out Patent 62-158966, the outlet temperature and intermediate temperature of a heat exchanger are compared and calculated, and excess or shortage or leak of refrigerant is detected.

It involves the following problems. FIG. 9 is a side view of a heat exchanger in a prior art. As shown in FIG. 9, in a heat exchanger 80, there are plural fins 6 between side boards 7, and a heat transfer conduit 5 and U-pipes 32 to 40 penetrate through the fins 6. Refrigerant enters from an inlet 31, and is discharged from an outlet 41. A second temperature detector 21 for detecting the refrigerant temperature in the heat exchanger is provided in a middle part of the heat exchanger.

In a method for detecting the temperature at the outlet 40 of the heat exchanger and the temperature in the middle part 36, since a differential temperature of $\Delta T$ occurs at the ratio of charging refrigerant of about 40 to 70%, refrigerant leak can be detected, but the differential temperature $\Delta T$ decreases at about 40%, and refrigerant leak cannot be detected.

In Japanese Laid-out Patent 1-107070, on the other hand, in addition to the differential temperature at the inlet and outlet of refrigerant in the heat exchanger, the differential temperature at the inlet and outlet of the air side is also included in the operation to detect shortage of refrigerant and leak of refrigerant.

However, in the method of detecting the differential temperature of the inlet and outlet of refrigerant, the refrigerant temperature at the evaporator inlet drops suddenly along with decline of suction pressure due to shortage of refrigerant, and hence it is not effective for detection of refrigerant leak. Moreover, these methods require two or more sensors for detecting temperature in the evaporator, and the cost is increased.

Or, in the method of detecting the inlet and outlet temperature at the air side, it also adds to the cost because a temperature detecting sensor is needed in the blow-out part of the indoor unit side.

In Japanese Laid-out Patent 6-137725, meanwhile, the refrigerant temperature in the refrigeration system is detected at specific time intervals, and the refrigerant leak is judged from its changing amount.

This method is, however, constituted to detect the refrigerant temperature in the refrigeration system at specific time intervals, and judge the refrigerant leak by the changing amount of the superheat, and accordingly, same as in the method of detecting the differential temperature at the refrigerant inlet and outlet, capacity drop of evaporator due to refrigerant shortage cannot be detected precisely. In this method, yet, since the changing amount of the refrigerant temperature in the refrigeration system is always stored in order to judge refrigerant leak, the operation is complicated.

SUMMARY OF THE INVENTION

The refrigerating apparatus of the invention comprises a refrigeration system using a hydrofluorocarbon refrigerant, including a compressor, an evaporator, an expansion device, and a condenser, being sequentially coupled together annularly through a conduit, a first temperature detector for detecting the air temperature at the suction port of the evaporator, a second temperature detector for detecting the refrigerant temperature at an intermediate part of the evaporator, and a differential temperature detector for calculating the differential pressure of the air temperature and refrigerant temperature which are output values from the first temperature detector and second temperature detector, so that a refrigerant leak is judged from the differential temperature.

Preferably, this constitution further comprises a running time detector for storing the cumulative running time of the compressor, so that a refrigerant leak is judged from the differential temperature and the cumulative running time.

In this constitution, if the refrigerant leaks and the refrigerant amount in the refrigeration system becomes insufficient, the circulation of the refrigerant decreases, and therefore the refrigerant average temperature in the evaporator becomes closer to the air temperature at the suction port of the evaporator as compared with the normal running state. By the differential temperature of the refrigerant temperature in the middle part of the evaporator provided to detect the refrigerant average temperature in the evaporator precisely and the air temperature at the suction port of the evaporator, capacity drop due to refrigerant leak can be detected.

Moreover, by simultaneously monitoring the cumulative running time of the compressor in order to prevent detection error during stop of the compressor, if a refrigerant leak occurs, it can be detected early and securely.

DETAILED DESCRIPTION OF THE PREFERRED EMBODIMENTS

Figure 1:
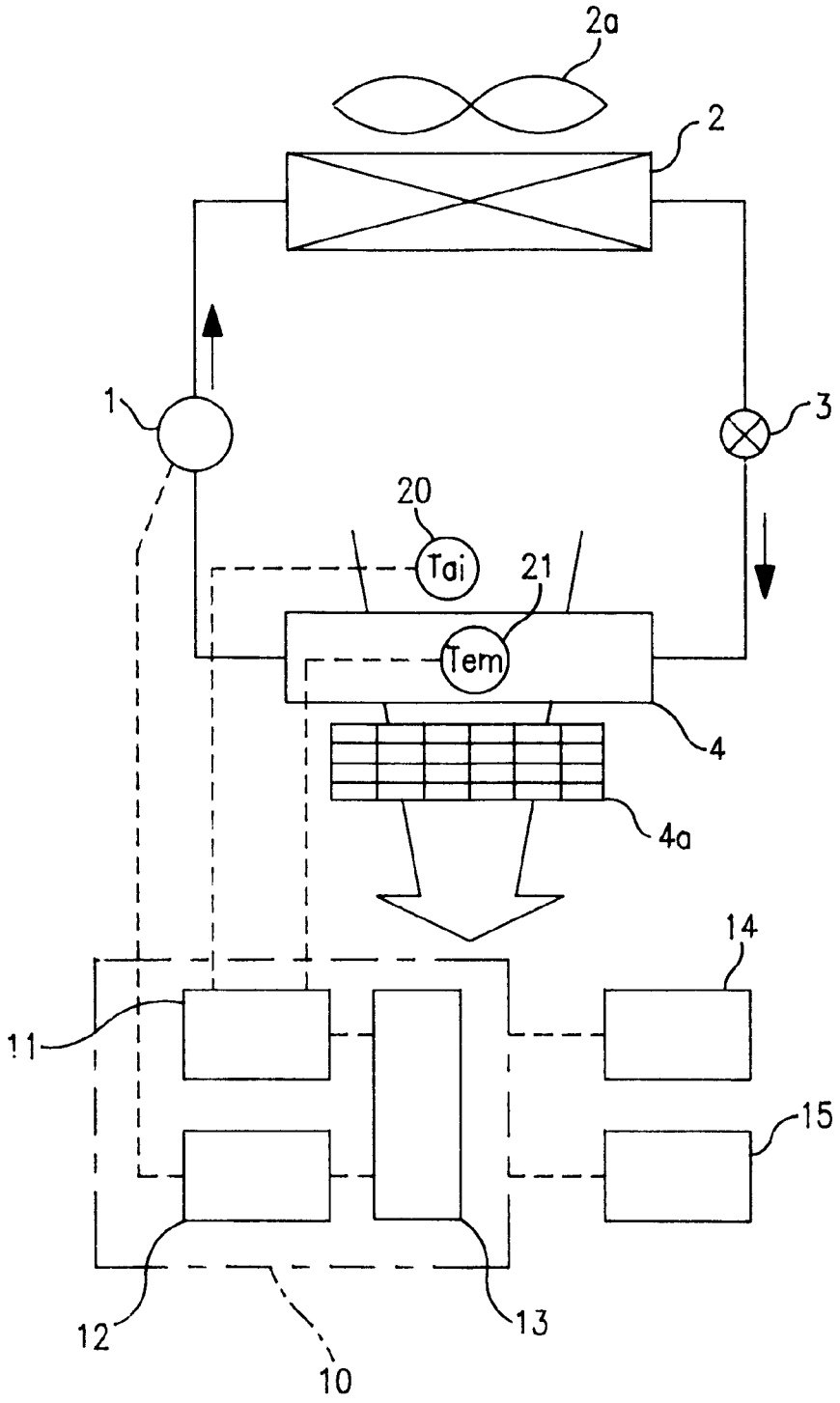
FIG. 1 is a block diagram showing a constitution of a refrigeration control apparatus in an exemplary embodiment of the invention.

FIG. 1 shows a constitution of a refrigeration system control apparatus in a first embodiment of the invention. In FIG. 1, the refrigerating apparatus comprises a refrigeration system and a control apparatus. The refrigeration system is composed of a compressor 1, a condenser 2, an expansion device 3, and an evaporator 4, coupled together through a conduit. Heat exchangers such as the condenser 2 and evaporator 4 exchange heat with air through a fan for condenser 2*a* and a fan for evaporator 4*a*. A first temperature detector 20 for detecting the suction temperature of the evaporator and a second temperature detector 21 for detecting the refrigerant temperature at the middle part of the evaporator are provided, and are coupled to a microcomputer 10. The microcomputer incorporates a differential temperature detector 11 for detecting the differential temperature of air temperature and refrigerant temperature, a running time detector 12 for storing the cumulative running time of the compressor, and means for deciding the leak of refrigerant 13 for judging refrigerant leak by comparing the differential temperature detector 11 and running time detector 12. A display apparatus 14 and a running apparatus 15 are also connected to the microcomputer 10. The refrigeration system is packed with R410A. Thus, the refrigeration system control apparatus is constituted.

Figure 2:
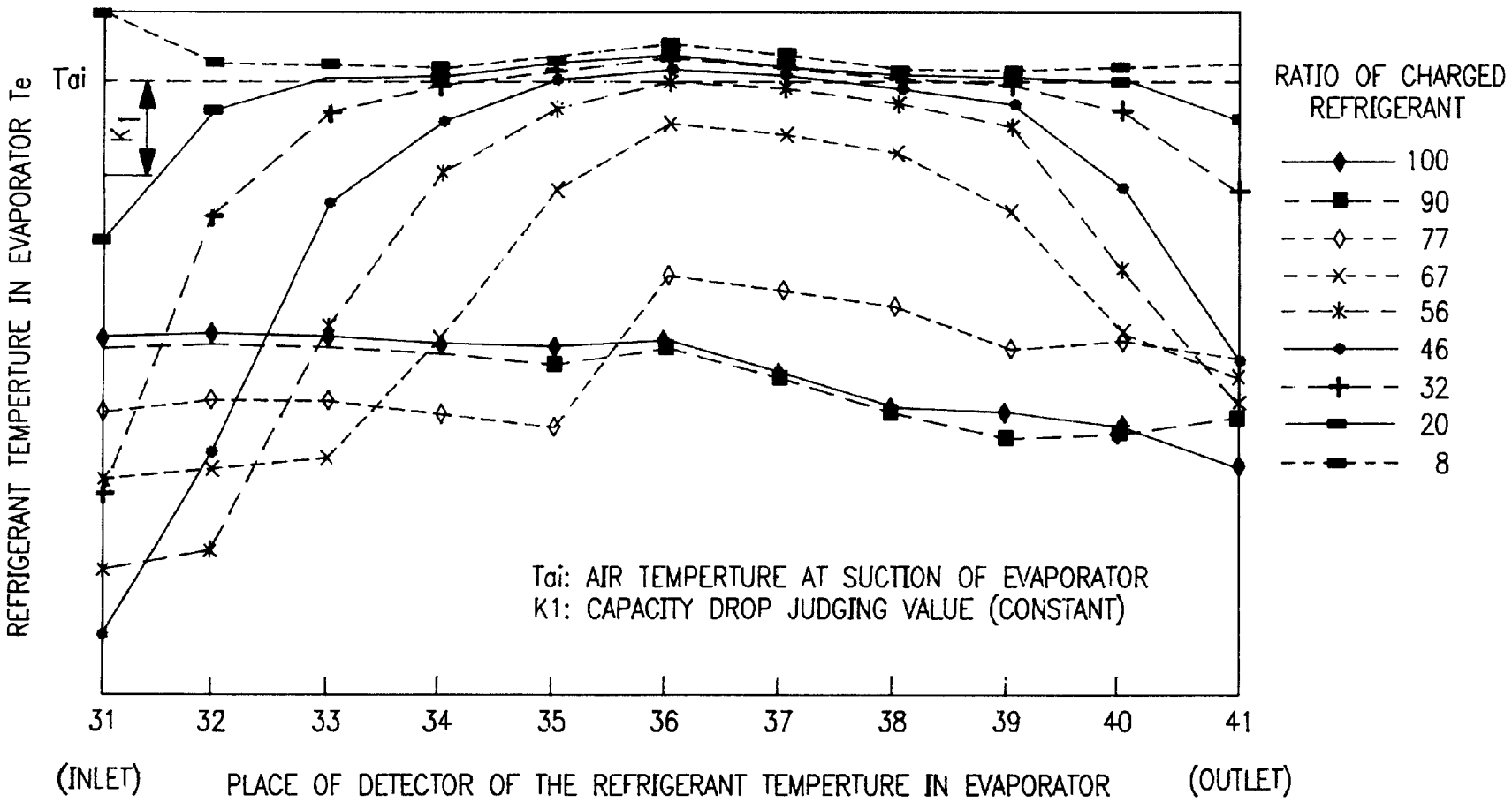
FIG. 2 is an evaporator temperature distribution characteristic diagram in the event of leakage of R410A refrigerant in a refrigeration control apparatus in an exemplary embodiment of the invention.
Figure 3:
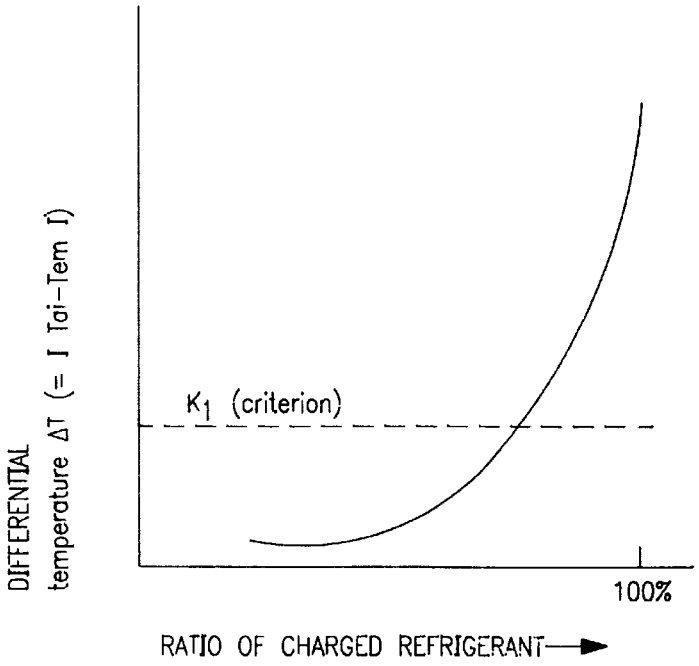
FIG. 3 is a characteristic diagram of ratio of charging refrigerant and differential temperature of evaporator (suction air—refrigerant) in a refrigeration control apparatus in an exemplary embodiment of the invention.
Figure 4:
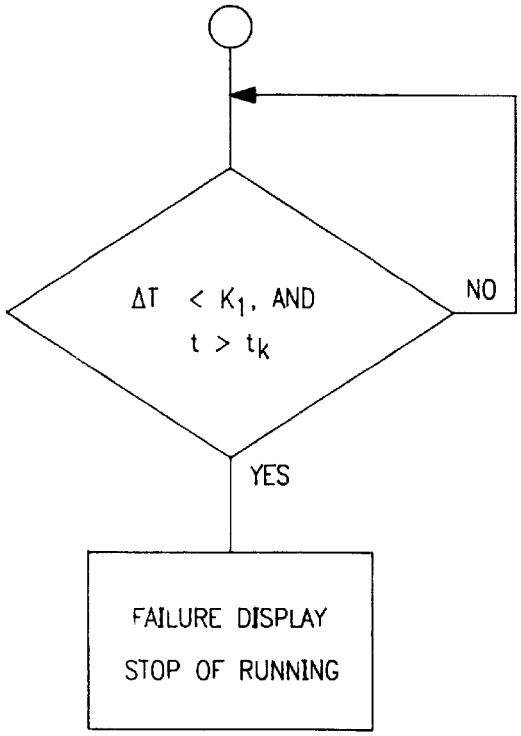
FIG. 4 is a flowchart relating to refrigerant leak detection in a refrigeration control apparatus in an exemplary embodiment of the invention.

The operation is described below. When a refrigerant leaks, using R410A, the relation between the detecting position and refrigerant temperature of the evaporator is shown in FIG. 2. A characteristic diagram showing the relation between the ratio of charging refrigerant and evaporator is given in FIG. 3. A flowchart for detection of refrigerant leak is shown in FIG. 4. In FIG. 2, when the refrigerant amount decreases, it is known that the refrigerant temperature Tem at the middle part of the evaporator (position 36) detected by the second temperature detector 21 becomes gradually closer to the evaporator suction air temperature Tai detected by the first temperature detector 20. This differential temperature $\Delta T$ (=|Tai−Tem|), that is, the capacity of heat exchanger becomes smaller as the refrigerant amount decreases as shown in FIG. 3. Therefore, when the differential temperature $\Delta T$ becomes lower than a specific value, it may be judged that the refrigerating capacity is lowered due to refrigerant leak or refrigerant shortage. However, when stopping operation in the compressor, when operating the inverter type compressor at low speed, or in a transient state when starting up operation, since the differential temperature $\Delta T$ approaches 0, a detection error may occur by the detection of differential temperature alone. Accordingly, in the condition where the refrigerating apparatus requires a refrigerating capacity, the compressor is not stopped, or an inverter compressor is operated continuously at a rated rotating speed, and considering from such relation, the cumulative running time t of the compressor is detected by the running time detector 12 for storing the running state of the compressor, and when the cumulative time t exceeds a specific value, it may be judged that the refrigerating capacity is lowered due to refrigerant leak or refrigerant shortage. Therefore, as shown in the flowchart in FIG. 4 for detecting refrigerant leak, when the differential temperature $\Delta T$ is lower than a criterion $K_1$, and the cumulative running time t of the compressor exceeds a criterion $t_{K1}$, a refrigerant leak is judged. According to this judgement, a failure display of refrigerant leak is shown in the display apparatus 14 in FIG. 1, and, if necessary, the operation of the compressor is stopped by the running apparatus 15.

Figure 5:
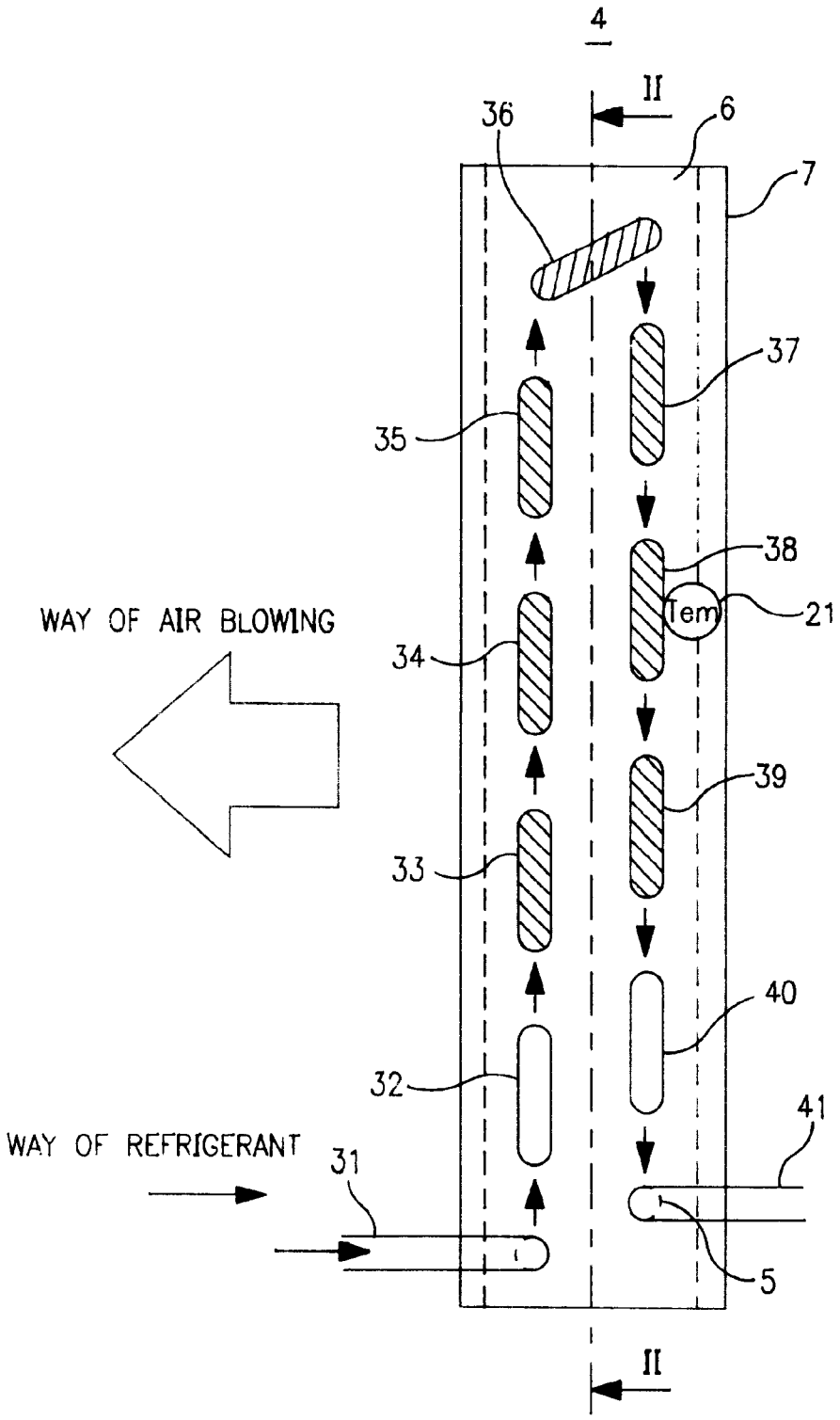
FIG. 5 is an explanatory diagram of a section from the side of an evaporator showing the position for detecting the refrigerant temperature of the evaporator in a refrigeration control apparatus in an exemplary embodiment of the invention.

The position for detecting the temperature by the second temperature detector 21 is described below while referring to the drawing. A lateral view of a multi-row and multi-stage compressor of one row or more (herein 2 rows and 10 stages) is shown in FIG. 5. In the heat exchanger 4, there are plural fins 6 between side boards 7, and a heat transfer conduit 5 and U-pipes 32 to 40 penetrate through the fins 6. A refrigerant is fed through an inlet 31, and is discharged through an outlet 41. The position for installing the second temperature detector 21 for detecting the refrigerant temperature of the evaporator should exclude the inlet and outlet of refrigerant conduit of evaporator 31, 41 of the evaporator 4, and the refrigerant conduit close to the inlet and outlet of the evaporator.

The reason for specifying the position for installing the second temperature detector 21 is described below.

In FIG. 5, if the position for installing the second temperature detector is limited by the constitution of the evaporator or air-conditioner, it may not be installed at the U-pipe 36 at the middle part of the evaporator. The detecting position is reviewed herein. As shown in FIG. 2, as the evaporator inlet pressure drops due to refrigerant leak, the refrigerant temperature in the U-pipe 32 close to the inlet of refrigerant conduit of evaporator 31 and conduit inlet is lowered, whereas the U-pipe 40 near the outlet of refrigerant conduit of evaporator 41 and conduit outlet is lowered in the refrigerant temperature because overheat is likely to cool down. However, the refrigerant temperature in other refrigerant conduits, herein, U-pipes 33 to 39, is not influenced by decline of temperature at inlet and outlet of evaporator, so that the refrigerant temperature at the middle part of the evaporator can be detected. Therefore, by installing the second temperature detector 21 at other positions than the inlet and outlet of refrigerant conduit and the refrigerant conduit close to the inlet and outlet of evaporator, drop of refrigerating capacity due to refrigerant leak can be detected.

Incidentally, as the first temperature detector and second temperature detector, for example, various temperature sensors, elements, devices, and thermistors can be used.

Figure 6:
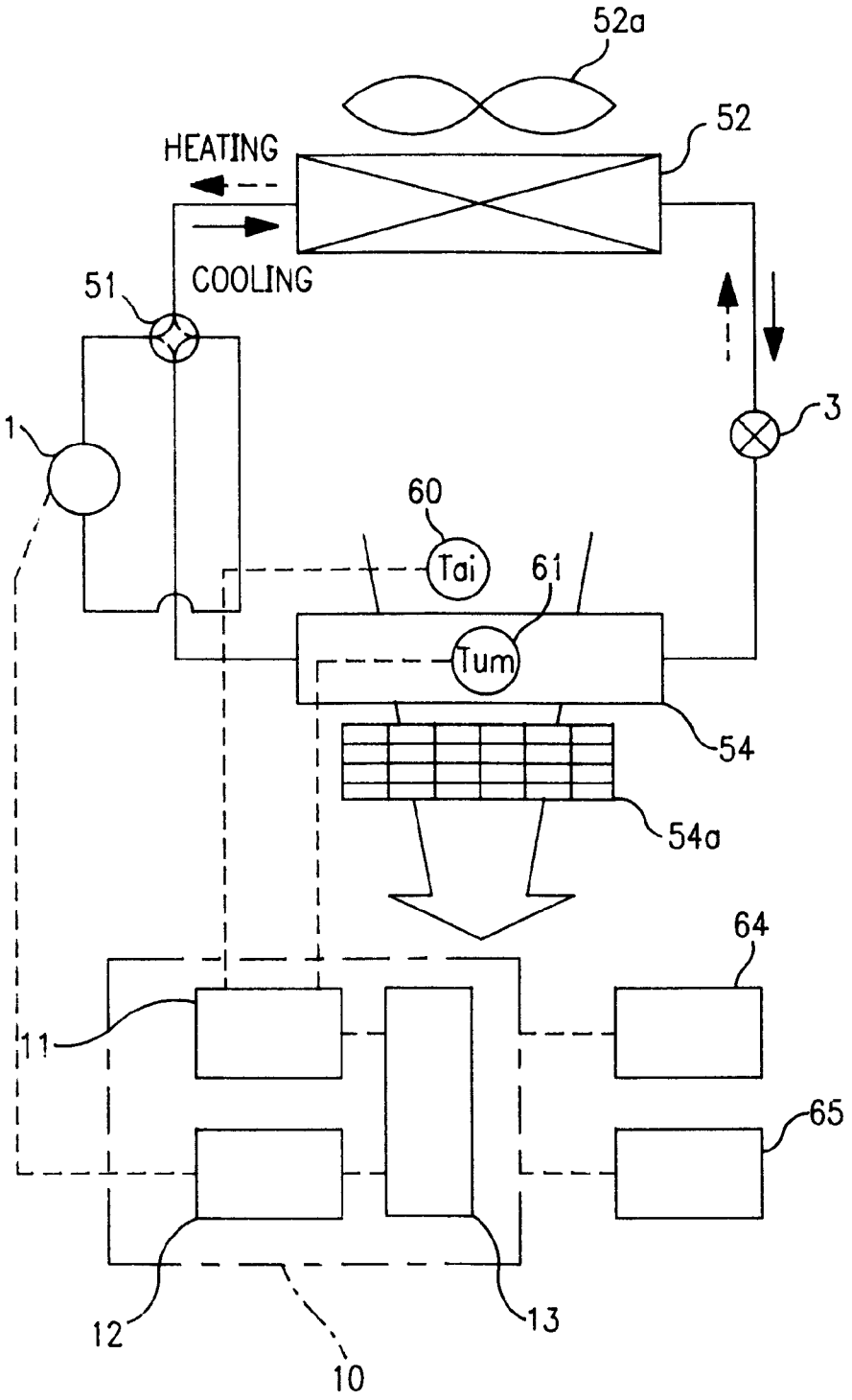
FIG. 6 is a block diagram showing a constitution of a refrigeration control apparatus in an exemplary embodiment of the invention.

A second embodiment is described below while referring to the drawing. A constitution of the refrigerating apparatus in the second embodiment of the invention is shown in FIG. 6. This embodiment shows a heat pump type refrigerating apparatus as an example of refrigerating apparatus.

In FIG. 6, the refrigerating apparatus comprises a heat pump type refrigeration system and a control apparatus. The heat pump type refrigeration system is composed of a compressor 1, a reversing valve 51, a first heat exchanger 54, an expansion device 3, and a second heat exchanger 52, being coupled together through a conduit. Heat exchangers such as the second heat exchanger 52 and first heat exchanger 54 exchange heat with air through a fan for second heat exchanger 52*a* and a fan for first heat exchanger 54*a*. A first temperature detector 60 for detecting the suction temperature of the first heat exchanger and a second temperature detector 61 for detecting the refrigerant temperature at the middle part of the first heat exchanger are provided, and are coupled to a microcomputer 10. The microcomputer 10 incorporates a differential temperature detector 11 for detecting the differential temperature of air temperature and refrigerant temperature, a running time detector 12 for storing the cumulative running time of the compressor, and means for deciding the leak of refrigerant 13 for judging refrigerant leak by comparing the differential temperature detector 11 and running time detector 12. A display apparatus 64 and a running apparatus 65 are also connected to the microcomputer 10. The refrigeration system is packed with R410A. Thus, the heat pump type refrigerating apparatus is constituted.

Figure 7:
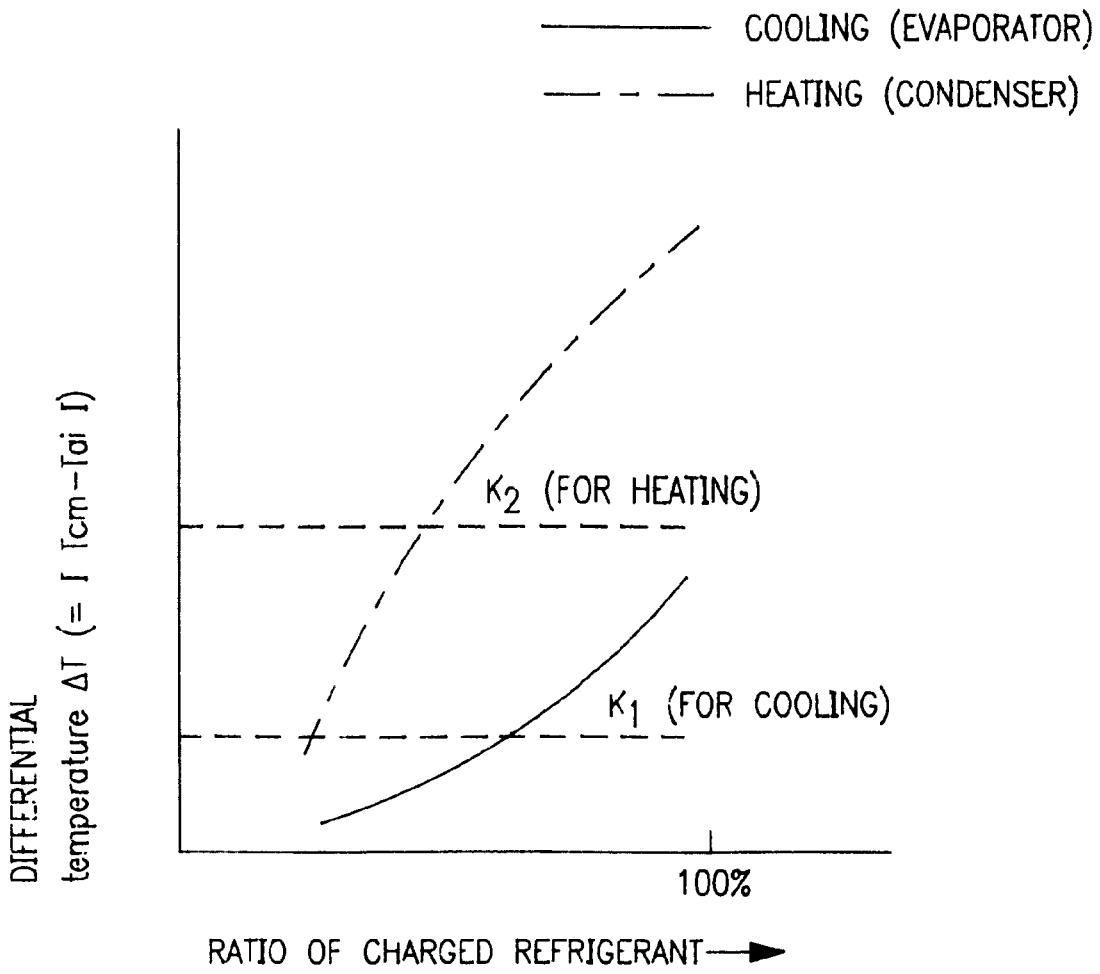
FIG. 7 is a characteristic diagram of ratio of charging refrigerant and first heat exchanger differential temperature |suction air—refrigerant temperature|) in an exemplary embodiment of the invention.
Figure 8:
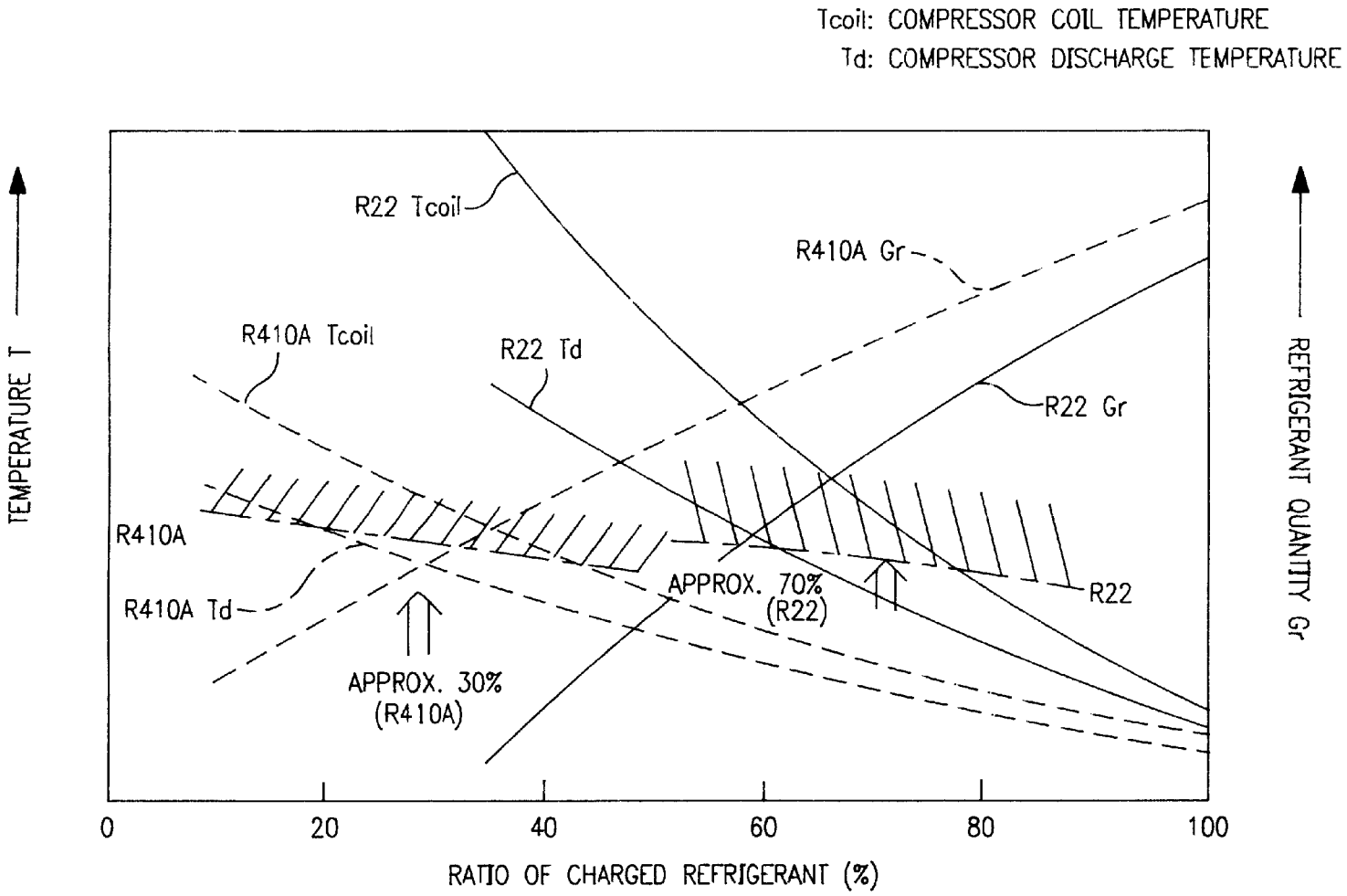
FIG. 8 PRIOR ART
FIG. 8 is a characteristic diagram showing effects of ratio charging refrigerant on the compressor coil temperature and refrigerant quantity in a conventional refrigerating apparatus.
Figure 9:
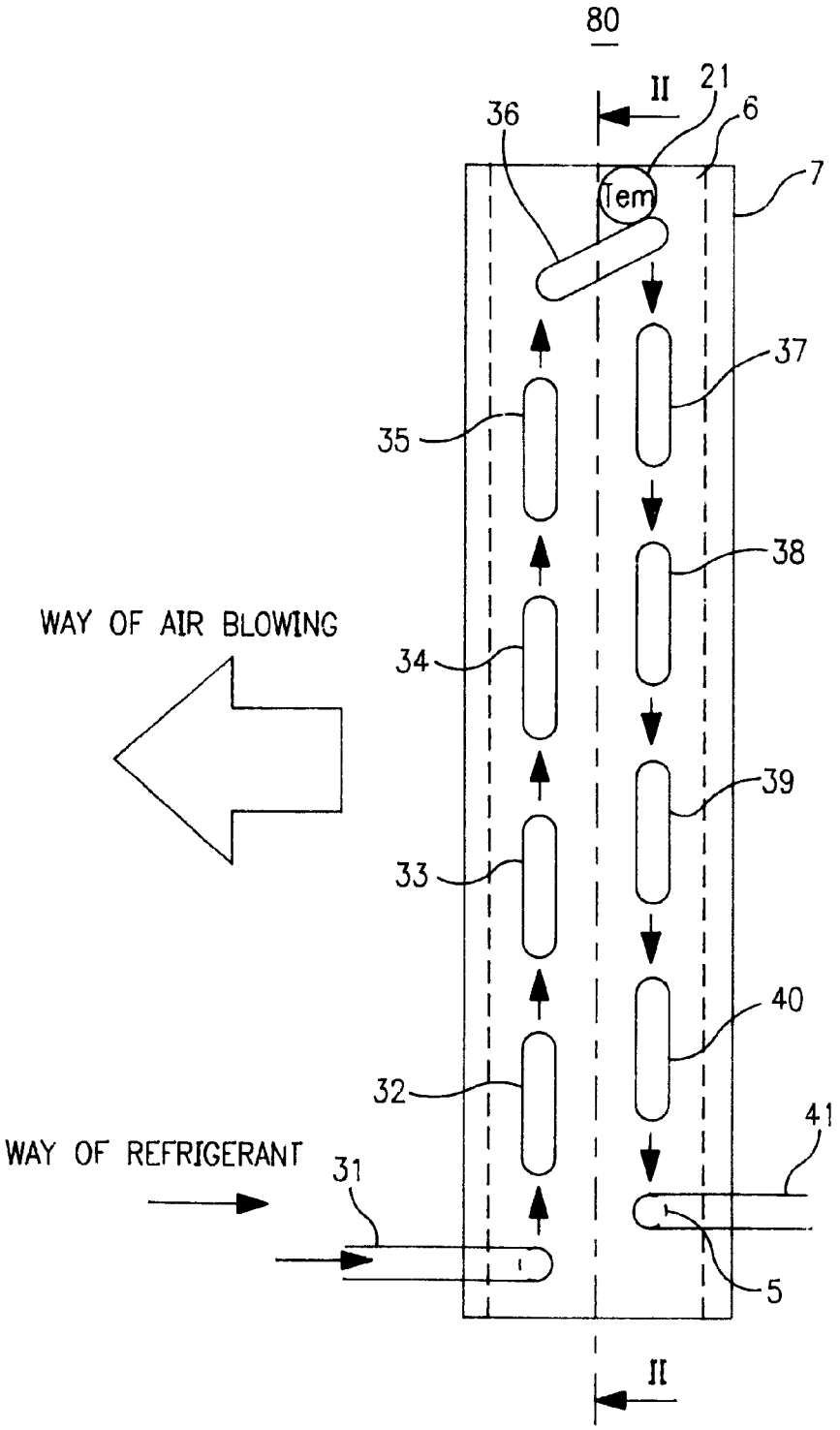
FIG. 9 PRIOR ART
FIG. 9 is an explanatory diagram of a section from the side the evaporator showing the position for detecting the refrigerant temperature of the evaporator in a prior art.

In cooling operation (solid line), that is, when the first heat exchanger 54 is used as evaporator, the operation is same as in the first embodiment, and the explanation is omitted. In heating operation (dotted line), that is, when the first heat exchanger is used as condenser, the differential temperature of the first heat exchanger refrigerant temperature Tcm and first heat exchanger suction air temperature Tai, ΔT (=Tcm−Tai), at the refrigerant quantity, that is, the first heat exchanger capacity decreases as the refrigerant amount decreases as shown in FIG. 7. Therefore, when the differential temperature ΔT becomes lower than a specific value, it is judged that the first heat exchanger capacity is lowered due to refrigerant leak or refrigerant shortage.

Herein, the method of detecting the running state of the compressor is same as shown in the first embodiment. Accordingly, in judgement of refrigerant leak shown in the embodiment in FIG. 3, by setting the judging constants in the flowchart for detecting refrigerant leak in FIG. 4 at $K_2$, $t_{K2}$ for heating, when the differential temperature ΔT is lower than the criterion $K_2$ and the cumulative running time of the compressor t is over the criterion $t_{K2}$, refrigerant leak is judged. According to this judgement, a failure display of refrigerant leak is shown in a display apparatus 64 in FIG. 6, and the compressor operation is stopped, if necessary, by a running apparatus 65.

In the foregoing embodiments, R410A is used, but when a single refrigerant of HFC-32 of which saturation pressure at same temperature is higher than in R22, or a mixed refrigerant of HFC-32/125 is used, the operation is nearly the same, and it is possible to use without being defined by the ratio of the mixed refrigerant.

As clear from the description herein, according to the refrigerating apparatus of the invention, in the refrigerating apparatus using HFC refrigerant, a refrigerant leak can be directly detected as drop of evaporator capacity, and by detecting the running state of the compressor at the same time, a refrigerant leak can be detected early and securely, and failure display or operation stopping is effected. As a result, there is a possibility that at least one of the following effects are obtained.

1) A refrigerant leak is detected early and securely.

2) Energy loss due to prolonged operation in refrigerant leak state is prevented.

3) Possibility of trouble of refrigerating apparatus due to abnormal operation in refrigerant leak state is lowered.

4) The existing apparatus of R22 refrigerating machine can be used, and it is low in cost.

5) The refrigerant temperature detecting means can be installed at a position corresponding to the constitution of the air-conditioner or heat exchanger.

Moreover, a refrigerant leak in the evaporator of the refrigerating apparatus or the heat pump apparatus can be detected directly as capacity drop of heat exchanger, so that:

6) A refrigerant leak in heating operation can be detected; and

7) A refrigerant leak can be detected by the same apparatus, whether in cooling or heating operation, and therefore a simple and inexpensive heat pump type refrigerating apparatus can be presented.

We claim:

1. A refrigeration system comprising:

a compressor, an evaporator having an air suction side and including conduit in which refrigerant is located, an expansion device, and a condenser, coupled together;

a first temperature detector for measuring temperature of air entering said evaporator;

a second temperature detector for measuring temperature of refrigerant inside said evaporator; and a differential temperature detector for calculating the difference between a) the temperature measured by the first temperature detector and b) the temperature measured by the second temperature detector to determine whether refrigerant leak has occurred.

2. A refrigeration system according to claim 1, wherein said refrigerant is one of (a) HFC-32; and (b) HFC-32 and HFC-125.

3. A refrigeration system comprising:

a compressor, an evaporator having an air suction side and including conduit in which refrigerant is located, an expansion device, and a condenser, coupled together;

a first temperature detector for measuring temperature of air entering said evaporator;

a second temperature detector for measuring temperature of refrigerant inside said evaporator;

a differential temperature detector for calculating the difference between a) the temperature measured by the first temperature detector and b) the temperature measured by the second temperature detector, and a running time detector for measuring running time of said refrigeration system;

wherein the difference between the temperature measured by the first temperature detector and the temperature measured by the second temperature detector and the accumulated running time of said refrigeration system are used to determine whether refrigerant leak has occurred.

4. A refrigeration system according to claim 3 wherein said refrigerant is one of (a) HFC-32; and (b) HFC-32 and HFC-125.

5. A refrigeration system according to claim 3, wherein said evaporator includes an inlet coupled to said expansion device and an outlet coupled to said compressor wherein said second temperature detector is located between said inlet and said outlet of said evaporator.

6. The refrigerant system according to claim 1 or 3, wherein said temperature of refrigerant inside the evaporator is a temperature of refrigerant at a position between an inlet and outlet of the evaporator conduit.

7. The refrigerant system according to claim 1 or 3, wherein said second temperature detector is located adjacent the evaporator conduit and between an inlet and outlet of the evaporator conduit.

8. The refrigerant system according to claim 1 or 3, wherein said temperature of refrigerant inside the evaporator is a temperature of refrigerant substantially at a middle of the evaporator conduit relative to an inlet and outlet of the evaporator conduit.

9. The refrigerant system according to claim 1 or 3, wherein said temperature of refrigerant inside the evaporator is a temperature of refrigerant at an intermediate position between an inlet and outlet of the evaporator conduit.

10. A heat pump system comprising:

a compressor, a reversing valve, a first heat exchanger having an air suction side and including conduit in which refrigerant is located, an expansion device, and a second heat exchanger coupled together;

a first temperature detector for measuring temperature of air entering said first heat exchanger;

a second temperature detector for measuring temperature of refrigerant inside said evaporator; and a differential temperature detector for calculating the difference between a) the temperature measured by the first temperature detector and b) the temperature measured by the second temperature detector to determine whether refrigerant leak has occurred.

11. A system according to claim 10 wherein said refrigerant is one of (a) HFC-32; and (b) HFC-32 and HFC-125.

12. A heat pump system comprising:

a compressor, a reversing valve, a first heat exchanger having an air suction side and including conduit in which refrigerant is located, an expansion device, and a second heat exchanger, coupled together;

a first temperature detector for measuring temperature of air entering said first heat exchanger;

a second temperature detector for measuring temperature of refrigerant inside said evaporator;

differential temperature detector for calculating the difference between a) the temperature measured by the first temperature detector and b) the temperature measured by the second temperature detector, and a running time detector for measuring running time of said refrigeration system;

wherein the difference between the temperature measured by the first temperature detector and the temperature measured by the second temperature detector and the accumulated running time of said refrigeration system used to determine whether refrigerant leak has occurred.

13. A heat pump system according to claims 12, wherein said refrigerant is one of (a) HFC-32; and (b) HFC-32 and HFC-125.

14. A heat pump system according to claim 12, wherein said first heat exchanger includes a first coupler and a second coupler wherein said first coupler is one of an inlet or outlet wherein said second coupler is another of the inlet or the outlet wherein said second temperature detector is located between said inlet and said outlet of said heat exchanger.

15. A heat pump system comprising:

a compressor, a reversing valve, a first heat exchanger having an air suction side and including conduit in which refrigerant is located, an expansion device, and a second heat exchanger, coupled together;

a first heat exchanger adjacent a first location;

a second heat exchanger adjacent a second location;

wherein said first heat exchanger operates as an evaporator when said first location has a lower temperature than said second location, a first temperature detector for measuring temperature of air entering said first heat exchanger;

a second temperature detector for measuring temperature of refrigerant inside said evaporator;

differential temperature detector for calculating the difference between a) the temperature measured by the first temperature detector and b) the temperature measured by the second temperature detector and a running time detector for measuring running time of said refrigeration system;

wherein the difference between the temperature measured by the first temperature detector and the temperature measured by the second temperature detector and the accumulated running time of said refrigeration system are used to determine whether refrigerant leak has occurred.

16. A heat pump system according to claim 15, wherein said refrigerant is one of (a) HFC-32; and (b) HFC-32 and HFC-125.

17. A heat pump system according to claim 15, wherein said first heat exchanger includes a first coupler and a second coupler wherein said first coupler is one of an inlet or outlet wherein said second coupler is another of the inlet or the outlet wherein said second temperature detector is located between said inlet and said outlet of said evaporator.

18. The heat pump system according to claim 10, 12, or 15, wherein said temperature of refrigerant inside the evaporator is a temperature of refrigerant at a position between an inlet and outlet of the evaporator conduit.

19. The heat pump system according to claim 10, 12 or 15, wherein said second temperature detector is located adjacent the evaporator conduit and between an inlet and outlet of the evaporator conduit.

20. The heat pump system according to claim 10, 12 or 15, wherein said temperature of refrigerant inside the evaporator is a temperature of refrigerant substantially at a middle of the evaporator conduit relative to an inlet and outlet of the evaporator conduit.

21. The heat pump system according to claim 10, 12 or 15, wherein said temperature of refrigerant inside the evaporator is a temperature of refrigerant at an intermediate position between an inlet and outlet of the evaporator conduit.

22. A method for detecting refrigerant leakage in a refrigeration system which includes a compressor, an evaporator having an air suction side and including conduit in which refrigerant is located, an expansion device, an a condenser coupled together, said method comprising the steps of:

a) measuring temperature of air entering said evaporator;

b) measuring temperature of refrigerant inside said evaporator; and c) calculating the difference between the temperature measured in steps a) and b) to determine if refrigerant leakage has occurred.

23. A method of detecting refrigerant leakage in a refrigeration system according to claim 22, wherein said refrigerant is one of (a) HFC-32; and (b) HFC-32 and HFC-125.

24. A method of detecting refrigerant leakage in a refrigeration system which includes a compressor, an evaporator having an air suction side and including conduit in which refrigerant is located, an expansion device, and a condenser coupled together and, said method comprising the steps of:

a) measuring temperature of air entering said evaporator b) measuring temperature of refrigerant inside said evaporator;

c) calculating the difference between the temperature measured in stages a) and b);

d) measuring accumulated running time of said refrigeration system; and e) using the difference calculated in step c) and running time measured in step d) to determine if refrigerant leakage has occurred.

25. A method of detecting refrigerant leakage in a refrigeration system according to claim 24, wherein said refrigerant is one of (a) HFC-32; and (b) HFC-32 and HFC-125.

26. A method of detecting refrigerant leakage in a heat pump system which includes a compressor, a reversing valve, a first heat exchanger having an air suction side and including conduit in which refrigerant is located, an expansion device, and a second heat exchanger coupled together, said method comprising the steps of:

a) measuring temperature of air entering said a first heat exchanger;

b) measuring temperature of refrigerant inside said evaporator; and c) calculating the difference between the temperature measured in stages a) and b) to determine if refrigerant leakage has occurred.

27. A method of detecting refrigerant leakage in a heat pump system according to claim 26, wherein said refrigerant is one of (a) HFC-32; and (b) HFC-32 and HFC-125.

28. A method of detecting refrigerant leakage in a heat pump system which includes a compressor, a reversing valve, a first heat exchanger having an air suction side and including conduit in which refrigerant is located, an expansion device, and a second heat exchanger coupled together said method comprising the steps of:

a) measuring temperature of air entering said evaporator;

b) measuring temperature of refrigerant inside said evaporator;

c) calculating the difference between the temperature measured in stages a) and b);

d) measuring accumulated running time of said refrigeration system; and e) using the difference calculated in step c) and running time measured in step d) to determine if refrigerant leakage in a heat pump system.

29. A method of detecting refrigerant leakage in a heat pump system according to claim 28, wherein said refrigerant is one of (a) HFC-32; and (b) HFC-32 and HFC-125.

30. A method of detecting refrigerant leakage in a heat pump system which includes a compressor, a reversing valve, a first heat exchanger having an air suction side and including conduit in which refrigerant is located, an expansion device, and a second heat exchanger coupled together, wherein the first heat exchanger is operable as an evaporator when the location of said first heat exchanger has a lower temperature than the location of said second heat exchanger, said method comprising the steps of:

a) measuring temperature of air entering said evaporator;

b) measuring temperature of refrigerant inside said evaporator;

c) calculating the difference between the temperature measured in stages a) and b);

d) measuring accumulated running time of said refrigeration system; and e) using the difference calculated in step c) and running time measured in step d) to determine if refrigerant leakage in a heat pump system.

31. A method of detecting refrigerant leakage in a heat pump system according to claim 30, wherein said refrigerant is one of (a) single refrigerant of HFC-32; and (b) mixed refrigerant of HFC-32 and HFC-125.

32. The method according to claim 22, 24, 26, 28 or 30, wherein said temperature of refrigerant inside the evaporator is a temperature of refrigerant at a position between an inlet and outlet of the evaporator conduit.

33. The method according to claim 22, 24, 26, 28 or 30, wherein said second temperature detector is located adjacent the evaporator conduit and between an inlet and outlet of the evaporator conduit.

34. The method according to claim 22, 24, 26, 28 or 30, wherein said temperature of refrigerant inside the evaporator is a temperature of refrigerant substantially at a middle of the evaporator conduit relative to an inlet and outlet of the evaporator conduit.

35. The method according to claim 22, 24, 26, 28 or 30, wherein said temperature of refrigerant inside the evaporator is a temperature of refrigerant at an intermediate position between an inlet and outlet of the evaporator conduit.

* * * * *